US012281573B2

(12) United States Patent
Merkel et al.

(10) Patent No.: US 12,281,573 B2
(45) Date of Patent: Apr. 22, 2025

(54) PULSED POWER DRILLING TOOL AND A METHOD FOR BREAKING A MINERAL SUBSTRATE

(71) Applicant: EPIROC ROCK DRILLS AKTIEBOLAG, Örebro (SE)

(72) Inventors: Harald Merkel, Örebro (SE); Erik Jakobsson, Örebro (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 0 days.

(21) Appl. No.: 18/574,740

(22) PCT Filed: May 16, 2022

(86) PCT No.: PCT/SE2022/050472
§ 371 (c)(1),
(2) Date: Dec. 27, 2023

(87) PCT Pub. No.: WO2023/277751
PCT Pub. Date: Jan. 5, 2023

(65) Prior Publication Data

US 2024/0344402 A1 Oct. 17, 2024

(30) Foreign Application Priority Data

Jun. 28, 2021 (SE) ..... 2130178-3

(51) Int. Cl.
*E21B 7/15* (2006.01)

(52) U.S. Cl.
CPC ..... *E21B 7/15* (2013.01)

(58) Field of Classification Search
CPC ..... E21B 7/15; E21C 37/18
See application file for complete search history.

(56) References Cited

U.S. PATENT DOCUMENTS 3,004,137 A * 10/1961 Karlovitz ..... E21B 7/15 148/194
3,500,942 A * 3/1970 Smith, Jr. ..... E21B 7/15 175/16

(Continued)

FOREIGN PATENT DOCUMENTS

CN 111255375 A * 6/2020
CN 112593849 A * 4/2021 ..... E21B 10/43

(Continued)

OTHER PUBLICATIONS

International Search Report and Written Opinion mailed Aug. 26, 2022 for International Application No. PCT/SE2022/050472, 8 pages.

*Primary Examiner* — Jennifer H Gay
(74) *Attorney, Agent, or Firm* — Sage Patent Group

(57) ABSTRACT

A pulsed power drilling tool configured for passing a pulsed electrical current through a mineral substrate to break the mineral substrate, the drilling tool including: a pulsed power generator for generating high voltage current pulses, a drill head including at least one pair of a first electrode and a second electrode, the first electrode including a first solid electrode portion and the second electrode including a second solid electrode portion, the first and second solid electrode portions being galvanically connectable to the pulsed power generator, and at least one ionization device configured for generating at least one ionized fluid volume extending at least from the first solid electrode portion to a surface of the mineral substrate, to allow a high voltage current pulse to pass between the first solid electrode portion and the second solid electrode portion via the at least one ionized fluid volume and the mineral substrate.

14 Claims, 6 Drawing Sheets

(56) References Cited

U.S. PATENT DOCUMENTS

| | | | | |
|---|---|---|---|---|
| 8,479,841 | B2 * | 7/2013 | Rosten | E21B 47/0232 175/50 |
| 11,085,245 | B2 * | 8/2021 | Liu | E21B 7/15 |
| 11,346,217 | B2 * | 5/2022 | Rowe | E21B 7/15 |
| 11,867,059 | B2 * | 1/2024 | Staack | E21B 4/02 |
| 2010/0212962 | A1 * | 8/2010 | Rosten | E21B 47/001 175/40 |
| 2013/0081874 | A1 | 4/2013 | Gutsol | |
| 2014/0361155 | A1 * | 12/2014 | Daito | E21B 49/10 250/256 |
| 2020/0217140 | A1 * | 7/2020 | Liu | E21B 7/15 |
| 2020/0217143 | A1 * | 7/2020 | Liu | E21B 10/60 |
| 2020/0224498 | A1 * | 7/2020 | Liu | E21B 10/60 |
| 2021/0396079 | A1 * | 12/2021 | Staack | E21B 4/02 |
| 2022/0065106 | A1 * | 3/2022 | Rowe | E21B 7/15 |
| 2024/0344402 | A1 * | 10/2024 | Merkel | E21B 7/15 |

FOREIGN PATENT DOCUMENTS

| | | | | | |
|---|---|---|---|---|---|
| CN | 112983283 | A | * | 6/2021 | E21B 10/43 |
| EP | 3047913 | A1 | | 7/2016 | |
| EP | 3739163 | A1 | | 11/2020 | |
| WO | 03069110 | A1 | | 8/2003 | |
| WO | 2006023998 | A2 | | 3/2006 | |
| WO | 2008097101 | A1 | | 8/2008 | |
| WO | WO-2023235994 | A1 | * | 12/2023 | E21B 41/0085 |
| WO | WO-2024237825 | A1 | * | 11/2024 | |
| WO | WO-2024237826 | A1 | * | 11/2024 | |
| WO | WO-2024263063 | A1 | * | 12/2024 | |
| WO | WO-2025005838 | A1 | * | 1/2025 | E21B 21/08 |

* cited by examiner

PULSED POWER DRILLING TOOL AND A METHOD FOR BREAKING A MINERAL SUBSTRATE

CROSS-REFERENCE TO RELATED APPLICATIONS

This application is a 35 U.S.C. § 371 national stage application for International Application No. PCT/SE2022/050472, entitled "A PULSED POWER DRILLING TOOL AND A METHOD FOR BREAKING A MINERAL SUBSTRATE", filed on May 16, 2022, which claims priority to Swedish Patent Application No. 2130178-3, filed on Jun. 28, 2021, the disclosures and contents of which are hereby incorporated by reference in their entireties.

TECHNICAL FIELD

The present disclosure relates to a pulsed power drilling tool for breaking a mineral substrate and to a method for breaking a mineral substrate by passing a pulsed electrical current through the mineral substrate. The disclosed tool and method may for example be applied in rock drilling, concrete processing, mineral processing, and continuous mining.

BACKGROUND

In the field of rock drilling, a new technology has emerged during the recent years, referred to as electro pulse boring (EPB), plasma channel drilling, pulsed plasma drilling, etc. The technology relies on mechanical electrodes creating contact with a rock material, and the application of a high voltage between the electrodes. The discharge occurring, if successful, penetrates the rock material and breaks loose small pieces. In some applications, an insulating fluid is proposed to prevent direct discharge between the electrodes. For most applications however, water has to be used for practical reasons, and in some cases even saline water. This makes it crucial to achieve a good contact between the electrodes and the rock material, since the discharge path through the water will otherwise become more attractive than the desired discharge path via the rock material.

A drill head usually comprises a plurality of electrode pairs. Since the rock surface is never ideally flat, one or more electrodes of the drill head are likely not to be in direct contact with the rock surface. Thus, some of the discharges are likely to occur directly between the electrodes, not penetrating the rock material. When the discharge does not penetrate the rock material, a loss of efficiency occurs. Ultimately, such a failed rock penetration will result in that no rock destruction is achieved.

Individually suspended, spring-loaded electrodes, each with rock contact, have earlier been proposed. However, such electrodes are fragile and prone to wear.

SUMMARY

A primary object of the present disclosure is to achieve an in at least some aspect improved drilling tool and method for pulsed power drilling. In particular, it is an object to achieve such a drilling tool and method which alleviate at least some of the drawbacks associated with prior art pulsed power drilling tools, such as non-penetrating discharge between the electrodes, low efficiency, and excess wear of the electrodes.

According to a first aspect of the disclosure, at least the primary object is achieved by a pulsed power drilling tool according to claim 1, hereinafter also referred to as a drilling tool. The drilling tool is configured for passing a pulsed electrical current through a mineral substrate to break the mineral substrate. It comprises:

- a pulsed power generator for generating high voltage current pulses,
- a drill head comprising at least one pair of a first electrode and a second electrode, the first electrode comprising a first solid electrode portion and the second electrode comprising a second solid electrode portion, the first and second solid electrode portions being galvanically connectable to the pulsed power generator, and
- at least one ionization device configured for generating at least one ionized fluid volume extending at least from the first solid electrode portion to a surface of the mineral substrate, so as to allow a high voltage current pulse to pass between the first solid electrode portion and the second solid electrode portion via the at least one ionized fluid volume and the mineral substrate.

By providing an ionization device for generating an ionized fluid volume between at least one of the solid electrode portions and the mineral substrate, a region of high conductivity can be achieved between the solid electrode portion and the mineral substrate. The ionized fluid volume will have a substantially higher conductivity in comparison with non-ionized fluid surrounding it, which means that the high voltage current pulse will pass through the ionized fluid volume from the solid electrode portion to the mineral substrate. By providing a volume of higher conductivity between the solid electrode portion and the mineral substrate, it is thereby possible to achieve an electrical contact between the solid electrode portion and the mineral substrate, which electrical contact is sufficient to guide the current into the mineral substrate without "leaking" into the surrounding environment of the ionized fluid volume. The electrical contact provided in this way is not dependent on any mechanical contact between the solid electrode portion and the mineral substrate. Thus, a good electrical contact may be achieved also with uneven substrate surfaces. Electrode wear as well as the risk for non-penetrating discharge between the electrodes can thereby be reduced, while the efficiency of the drilling process may be improved.

Another advantage of the disclosure is that the ionized fluid volume(s) may easily be adapted to the dielectric properties of the mineral substrate by, e.g., adjusting a degree of ionization, and/or by adjusting the flow of ionized fluid, for example to change a diameter of the ionized fluid volume. The degree of ionization times the flow will result in a certain conductivity of the ionized fluid, which may be exploited to reduce power reflectance at the surface of the mineral substrate. The possibilities for impedance matching are thus improved.

The high voltage current pulse will create a plasma channel in the mineral substrate, via which plasma channel the current pulse passes to the other electrode. In order for the current to pass between the electrodes, there has to be a difference in electric potential between the electrodes. The at least one pair of a first electrode and a second electrode may for this purpose comprise a positive electrode and a negative electrode, but it is also possible to, e.g., provide one positive or negative electrode and one electrode at zero potential.

The term "ionized fluid" is herein to be understood as encompassing plasma, containing both positively and negatively charged particles. The term "ionized fluid" is further to be understood as encompassing ionized gas and ionized liquid, as well as fluids containing electrically charged particles of solid matter, such as nanoparticles or microparticles.

Optionally, the at least one ionization device may be configured for generating a first ionized fluid volume extending at least from the first solid electrode portion to the surface of the mineral substrate, and a second ionized fluid volume extending at least from the second solid electrode portion to the surface of the mineral substrate, the first ionized fluid volume being isolated from the second ionized fluid volume so as to allow the high voltage current pulse to pass via the first ionized fluid volume, the mineral substrate and the second ionized fluid volume. In this case, no mechanical contact between either one of the solid electrode portions and the mineral substrate is needed, and thus electrode wear can be further reduced. The electrodes thereby become more robust and less expensive.

The isolation between the first ionized fluid volume and the second ionized fluid volume may, e.g., be achieved by supplying a shielding fluid, such as a liquid, with a relatively poor conductivity in comparison with the ionized fluid volumes and the solid electrode portions. The shielding fluid may, e.g., be a flushing fluid, such as water or even saline water.

Optionally, the second solid electrode portion may instead be configured to be mechanically applied against the mineral substrate, wherein the at least one ionized fluid volume is isolated from the second solid electrode portion. By mechanically applying the second solid electrode portion against the mineral substrate, correct positioning of the first solid electrode portion with respect to the mineral substrate is facilitated, i.e., positioning at a distance that will provide optimal conditions for creating the ionized fluid volume. The isolation between the ionized fluid volume and the second solid electrode portion may be achieved as explained above.

Optionally, the at least one ionization device comprises at least one plasma generator, and the drilling tool further comprises:

a compressed gas supply system for supplying compressed gas to the at least one plasma generator, wherein the at least one plasma generator is configured to ionize the compressed gas to generate a plasma, the at least one ionized fluid volume being formed by the plasma. Thus, in this case, the term "ionized fluid" refers to a plasma. The plasma generator, which may for example be of the type sometimes referred to as a plasma torch or a plasmatron, generates a stable ionized fluid volume from the compressed gas supply. In particular, a plasmatron/plasma torch efficiently generates a stable continuous plasma flow in an arbitrary gas. The compressed gas may be compressed air, or compressed noble gas, such as argon (Ar). Noble gas typically provides a more stable plasma, which is useful for relatively large distances between the solid electrode portion and the mineral substrate. Compressed air may on the other hand be readily and continuously formed using a compressor, does not need to be collected and recycled after use, and works well for relatively short distances between the solid electrode portion and the mineral substrate.

The plasma generator allows an ionization degree of the generated plasma to be controlled over orders of magnitude and within nanoseconds. Thus, the plasma properties, including conductivity and inductivity, can be easily adjusted to fit the needs of an optimized transport of the current pulse to the mineral substrate. This is especially important for fast and ultrafast pulses where a larger fraction of the pulse energy is due to electromagnetic waves travelling along the electrode. For any given ionization degree of the plasma, its inductive behaviour can be controlled at least over one order of magnitude by applying an external magnetic field, forcing the electrons of the plasma into helix trajectories. Therefore, the plasma itself may be used as a means to impedance match the high voltage current pulses, ensuring that a large fraction of the pulse energy is delivered to the mineral substrate and not lost elsewhere.

As alternatives to providing a plasma generator for generating the ionized fluid volume(s), it is possible to provide, e.g., an ultraviolet (UV) pulse source or a gamma source, such as an X-ray source, for generating a pulse of ionizing radiation. It is further possible to provide a thermal ionization device for thermal generation of ions, or to use a pre-discharge from the pulsed power generator to generate the ionized fluid volume(s).

Optionally, the at least one plasma generator comprises a low voltage power source arranged separately from the pulsed power generator.

Optionally, at least the first electrode comprises a first plasma generator, and further optionally the second electrode comprises a second plasma generator. Thus, for an electrode pair in which ionized fluid volumes are generated between both the first and the second solid electrode portions and the mineral substrate, respectively, the first and second electrodes may comprise their own plasma generators. For an electrode pair in which the second solid electrode portion is configured to be mechanically applied to the mineral substrate, a single plasma generator may be provided within the first electrode. In a drilling tool comprising a plurality of electrode pairs, a plasma generator may be comprised in one or both electrodes of each pair.

Optionally, each plasma generator comprises a casing, the casing being galvanically connectable to the pulsed power generator and further being galvanically connected to the solid electrode portion of the electrode in which the plasma generator is arranged. This enables passing the high voltage current pulse from the pulsed power generator to the plasma via the casing and the solid electrode portion.

Optionally, as an alternative, the at least one plasma generator is arranged upstream of the electrodes, the at least one plasma generator being configured to supply plasma to at least the first electrode and optionally to the second electrode. The high voltage current pulse is coupled to the plasma at the solid electrode portion(s) of the electrode(s), which solid electrode portion(s) is (are) herein not galvanically connected to the plasma generator. Thus, the electrode (s) is (are) located between the plasma generator and the mineral substrate, so that the plasma flows from the plasma generator, past the electrode(s) and to the mineral substrate. In this case, a single plasma generator can be used to supply plasma to a plurality of electrodes.

Optionally, the pulsed power drilling tool further comprises at least one shielding member configured for preventing the high voltage current pulses generated by the pulsed power generator from passing through the generated plasma to the at least one plasma generator. Such a shielding member or shielding members may for example be provided in an insulating housing of the plasma generator, in which insulating housing one or more conduits are provided for plasma to flow from the plasma generator to the electrode(s). The shielding member or members may for example comprise a series of corrugations or other surface structure provided in an inner wall of the insulating housing defining the conduit(s), which corrugations or surface structure prevent the high voltage current pulse from travelling "backward" through the plasma.

Optionally, the pulsed power drilling tool further comprises a fluid supply system for supplying a shielding fluid to a region between the drill head and the mineral substrate. The shielding fluid may be any fluid that may serve to shield the ionized fluid volume or volumes from each other and/or from one or more solid electrode portions of one or more other electrodes. The shielding fluid may preferably be a different fluid than the fluid of the ionized fluid volumes. The shielding fluid may, e.g., be a flushing liquid, such as water, which is typically supplied during the drilling operation.

Optionally, the drill head comprises at least one contact member protruding in an axial direction of the drilling tool with respect to at least the first solid electrode portion. The contact member may be arranged to provide a suitable distance between at least the first solid electrode portion and the mineral substrate. It may, e.g., be a solid electrode portion or a scraper, or another device.

Optionally, the drilling tool comprises a positioning device for controlling a distance between at least the first solid electrode portion and the surface of the mineral substrate. The positioning device may, e.g., comprise a sensor for measuring a distance between the solid electrode portion and the mineral substrate, and means for automatically adjusting the distance to a target value by adjusting the position of the drill head. Typically, a target value may be set to a distance of at least 1 mm, or at least 2 mm, or at least 3 mm, and to a distance of no more than 5 cm, or no more than 2 cm, or no more than 1 cm. Preferably, the target value may be within the range of 1-5 mm, such as 2-5 mm. The target value may be set depending on drill hole size, surface roughness of the mineral substrate, ionized fluid flow and properties of the ionized fluid, electrode diameter, etc. Ideally, the distance to the surface should be set so that a stable ionized fluid volume is achieved at least over the pulse time of the high voltage current pulse.

The positioning device may for example comprise means for performing impedance analysis, wherein the positioning device is configured to automatically position the drill head so as to fulfil an impedance criterion, such as to achieve an impedance below a predetermined threshold.

Optionally, the drill head comprises a plurality of scrapers arranged between the electrodes. The drilling tool should in this case be rotatable about a longitudinal axis of the drilling tool. In other embodiments without scrapers, the drilling tool does not need to be rotatable around the longitudinal axis.

According to a second aspect of the disclosure, at least the primary object is achieved by a method for breaking a mineral substrate according to claim 12. The method is performed by passing a pulsed electrical current through the mineral substrate by means of a pulsed power drilling tool according to the first aspect. The method comprises:

- positioning the drill head so that the solid electrode portions are at least in proximity of a surface of the mineral substrate,
- generating the at least one ionized fluid volume,
- generating and passing a high voltage current pulse from the first electrode to the second electrode via the at least one ionized fluid volume and the mineral substrate.

The first solid electrode portion may be positioned in proximity of the mineral substrate surface and the second solid electrode portion positioned in proximity of or in contact with the mineral substrate surface, depending on the configuration of the drilling tool.

Optionally, generating the at least one ionized fluid volume comprises ionizing compressed gas to generate a plasma, the at least one ionized fluid volume being formed by the plasma.

Optionally, the method further comprises:

- supplying a shielding fluid to a region between the electrodes at least during the action of passing the high voltage current pulse from the first electrode to the second electrode.

The method according to the second aspect may of course be performed by means of a pulsed power drilling tool according to any of the above-described embodiments of the second aspect. Thus, further advantages and advantageous features of the method appear from the above description of the drilling tool.

The present disclosure also relates to use of a pulsed power drilling tool according to the first aspect for breaking of a mineral substrate, such as in any one of rock drilling, concrete processing, mineral processing, and continuous mining.

Further advantages and advantageous features of the disclosure are disclosed in the following description and in the dependent claims.

BRIEF DESCRIPTION OF THE DRAWINGS

With reference to the appended drawings, below follows a more detailed description of embodiments of the disclosure cited as examples.

In the drawings.

Figure 1:
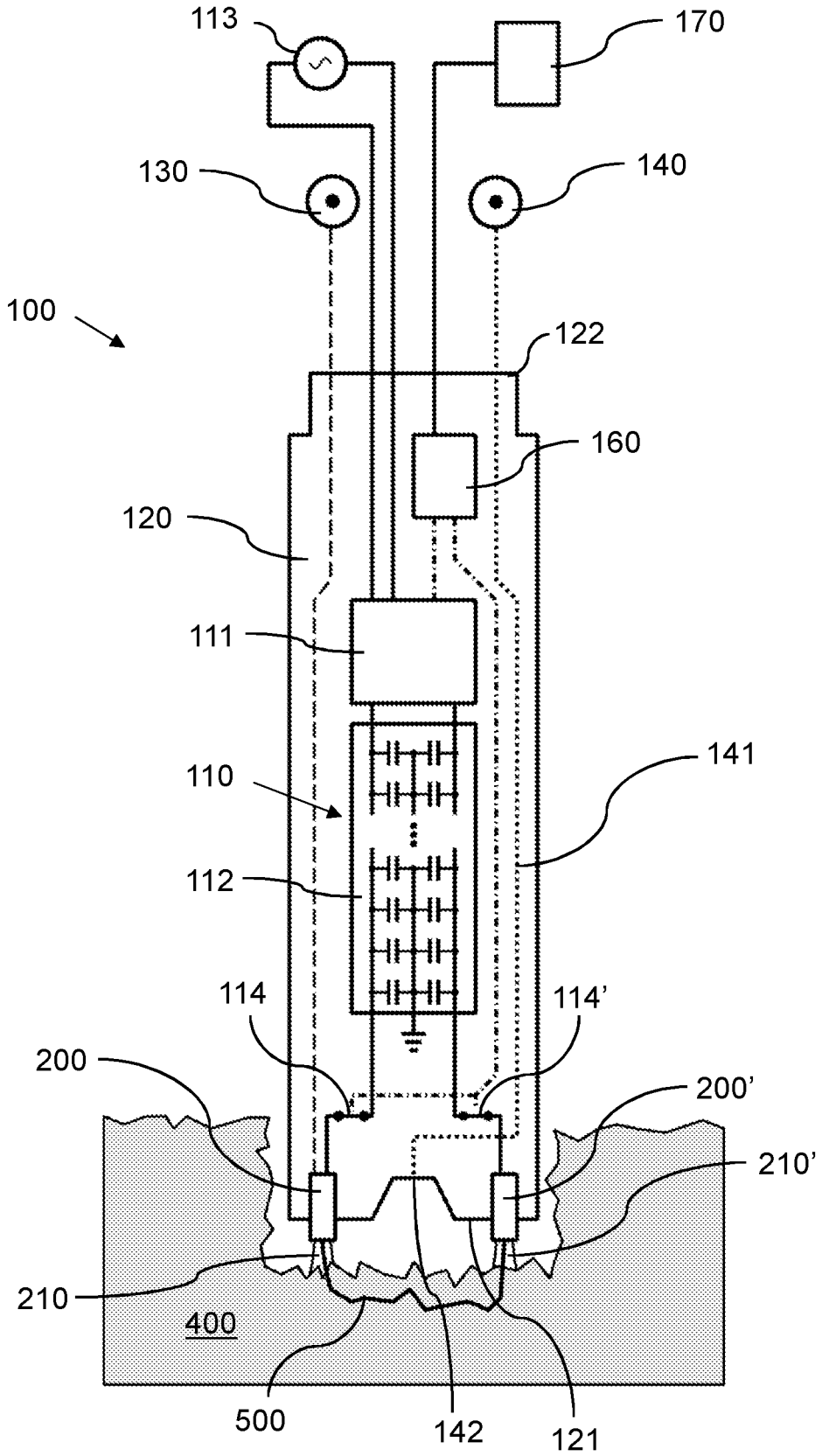
FIG. 1 schematically illustrates a pulsed power drilling tool according to an embodiment of the disclosure.

The drawings show diagrammatic, exemplifying embodiments of the present disclosure and are thus not necessarily drawn to scale. It shall be understood that the embodiments shown and described are exemplifying and that the disclosure is not limited to these embodiments. It shall also be noted that some details in the drawings may be exaggerated in order to better describe and illustrate the disclosure. Like reference characters refer to like elements throughout the description, unless expressed otherwise.

DETAILED DESCRIPTION OF EXAMPLE EMBODIMENTS OF THE DISCLOSURE

FIG. 1 schematically illustrates a pulsed power drilling tool 100 configured for passing a pulsed electrical current through a mineral substrate 400 to break it. The drilling tool 100 has a pulsed power generator 110 for generating high voltage current pulses, and a drill head 120 extending in an axial direction of the drilling tool 100 between a front end 121, configured to be positioned near or at a surface of the mineral substrate 400, and a rear end 122.

The pulsed power generator 110 comprises a pulse transformer 112 in the form of a bank of capacitors, connected to an alternating current (AC) power supply 113 via a transformer 111. Electrodes 200 and 200' are selected and connected using switches 114 and 114'. Using the switches 114 and 114', a short high voltage pulse is generated. The pulse is transferred to the electrodes 200 and 200'. The pulsed power generator is configured for generating pulses used for breaking the mineral substrate 400, such as nanosecond (ns) pulses to the electrodes 200 and 200'.

Figure 2A:
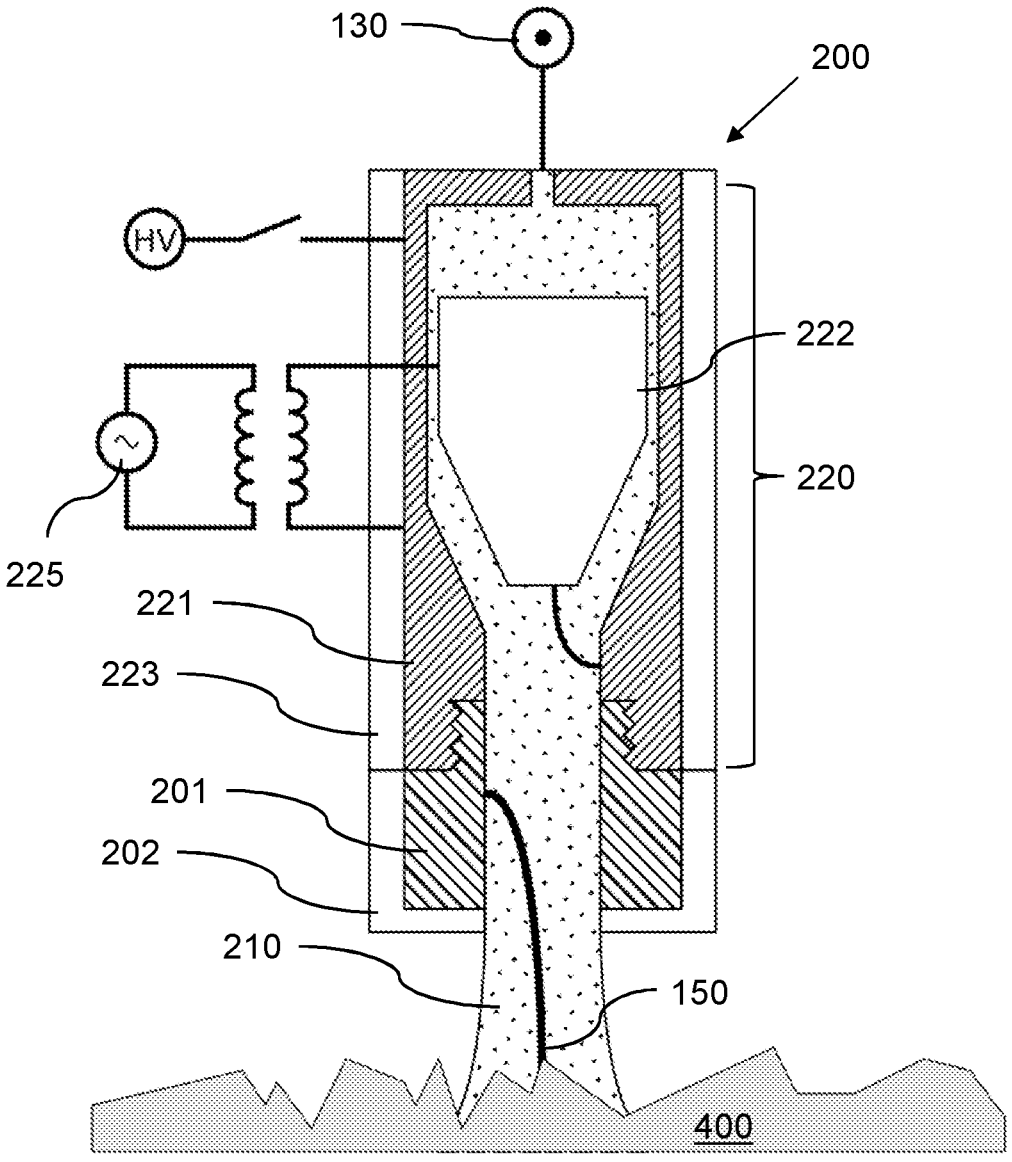
FIG. 2*a* is a sectional view of an electrode of the drilling tool in FIG. 1.

A pair of a first electrode 200 and a second electrode 200' are arranged at the front end 121 of the drill head 120, protruding slightly therefrom. Reference is also made to FIG. 2*a*, showing a sectional schematic view of the first electrode 200 arranged in proximity of the mineral substrate 400. The second electrode is in the embodiment shown in FIG. 1 identical to the first electrode 200, and only the first electrode 200 will therefore be described in detail.

The first electrode 200 comprises a hollow first solid electrode portion 201 arranged at a front end of the electrode 200. The solid electrode portion 201 is herein shown to be screw-mounted and thereby replaceable. It is made at least partially of electrically conductive material and may be either metallic or ceramic. At least a part must be heat resistant and capable to carry the plasma return current. By way of example, the solid electrode portion 201 may be made of tungsten, stainless steel, aluminum, copper, or zirconium oxide ceramics. An insulating protective skin 202 is provided on an external surface of the solid electrode portion 201, protecting it from direct contact with an environment surrounding the electrode 200.

The first electrode 200 further comprises an ionization device in the form of a plasma generator 220. The plasma generator 220 is configured for generating a first ionized fluid volume 210 in the form of a plasma, extending from the first electrode 200 to a surface of the mineral substrate 400. A compressed gas supply system 130 is provided for supplying compressed gas to the plasma generator 220 of each electrode 200, 200' (although only supply to the first electrode 200 is illustrated in FIG. 1), such as compressed air. The plasma generator 220 ionizes the compressed gas to generate a plasma. This may be carried out using standard procedures. For example, gas from the compressed gas supply system 130 may initially be passed through a pre-ionization stage, in which a low power high voltage source (typically 50 kV) generates a series of weak sparks that create some conducting pairs in the gas. Pre-ionization may also be achieved by means of, e.g., ultraviolet (UV) light. The pre-ionized gas is thereafter passed into an ionization stage.

In the shown embodiment, the plasma generator 220 uses in the ionization stage a low voltage power source 225, arranged separately from the pulsed power generator 110. The low voltage power source 225 is galvanically connected to on one hand a conductive casing 221 of the plasma generator 220, delimiting a cavity for ionizing the gas, and on the other hand a cone shaped plasmatron electrode 222, spaced apart from the casing 221 by a gap that may typically be a few millimeters depending on gas flow. The pre-ionized gas passes into the gap, wherein the electric field accelerates the conductive particles such that more than one charged particle will be generated on collision with charged and non-charged particles. Thus, an avalanche process is formed. The low voltage power source 225 may be a direct current (DC) or a slow AC power source. Typically, a drive voltage of 50-100 V and currents up to several amperes can be used, depending on gas flow and electrode geometry.

The plasma generator may in alternative embodiments use voltage current pulses from the pulsed power generator 110 for generating the plasma in the ionization stage. A series of pulses of different pulse lengths and voltage may be used for this purpose. For example, a pilot pulse of lower voltage and longer pulse duration than the main pulse used for breaking the mineral substrate 400 may be used to generate the plasma, such as a millisecond pulse preceding the nanosecond pulse for breaking the mineral substrate 400.

In another alternative embodiment, the plasma generator may use a magnetron attached to a microwave resonator in the ionization stage. In this case, pre-ionized gas is passed into the microwave resonator, which may, e.g., be a cavity formed within the electrode, and a set of resonator modes and at least one travelling wave mode are created in the cavity. The travelling wave mode accelerates the charged particles so that collisions create an avalanche process.

The solid electrode portions of the first and second electrodes 200, 200' are galvanically connectable to the pulsed power generator 110 by means of switches 114, 114'. This is in the embodiment illustrated in FIG. 2*a* achieved by galvanically connecting the conductive casing 221 to the solid electrode portion 201 and to the switch 114, so that a high voltage current pulse 150 generated by the pulsed power generator 110 passes through the casing 221 and to the solid electrode portion 201, where a discharge is formed between the solid electrode portion 201 and the mineral substrate 400 through the first ionized fluid volume 210. As the switches 114, 114' are closed, the high voltage current pulse 150 thus passes between the first solid electrode portion 201 of the first electrode 200 and the second solid electrode portion of the second electrode 200' via the first ionized fluid volume 210, the mineral substrate 400, and the second ionized fluid volume 210'. As a result, a plasma channel is formed in the mineral substrate 400 and the mineral substrate 400 is broken.

The drilling tool 100 further comprises a fluid supply system 140 for supplying a shielding fluid, such as a flushing fluid, e.g., water, to a region between the drill head 120 and the mineral substrate 400 via a fluid conduit 141 having an outlet 142 located between the first and the second electrodes 200, 200'. The flushing fluid isolates the first ionized fluid volume 210 from the second ionized fluid volume 210'. The insulating protective skin 202 protects the solid electrode portion 201 from direct contact with an environment surrounding the electrode 200. Also the plasma generator 220 has an insulating skin or coating 223 provided on its external surface, protecting the conductive casing 221 from direct contact with the flushing fluid.

Figure 2B:
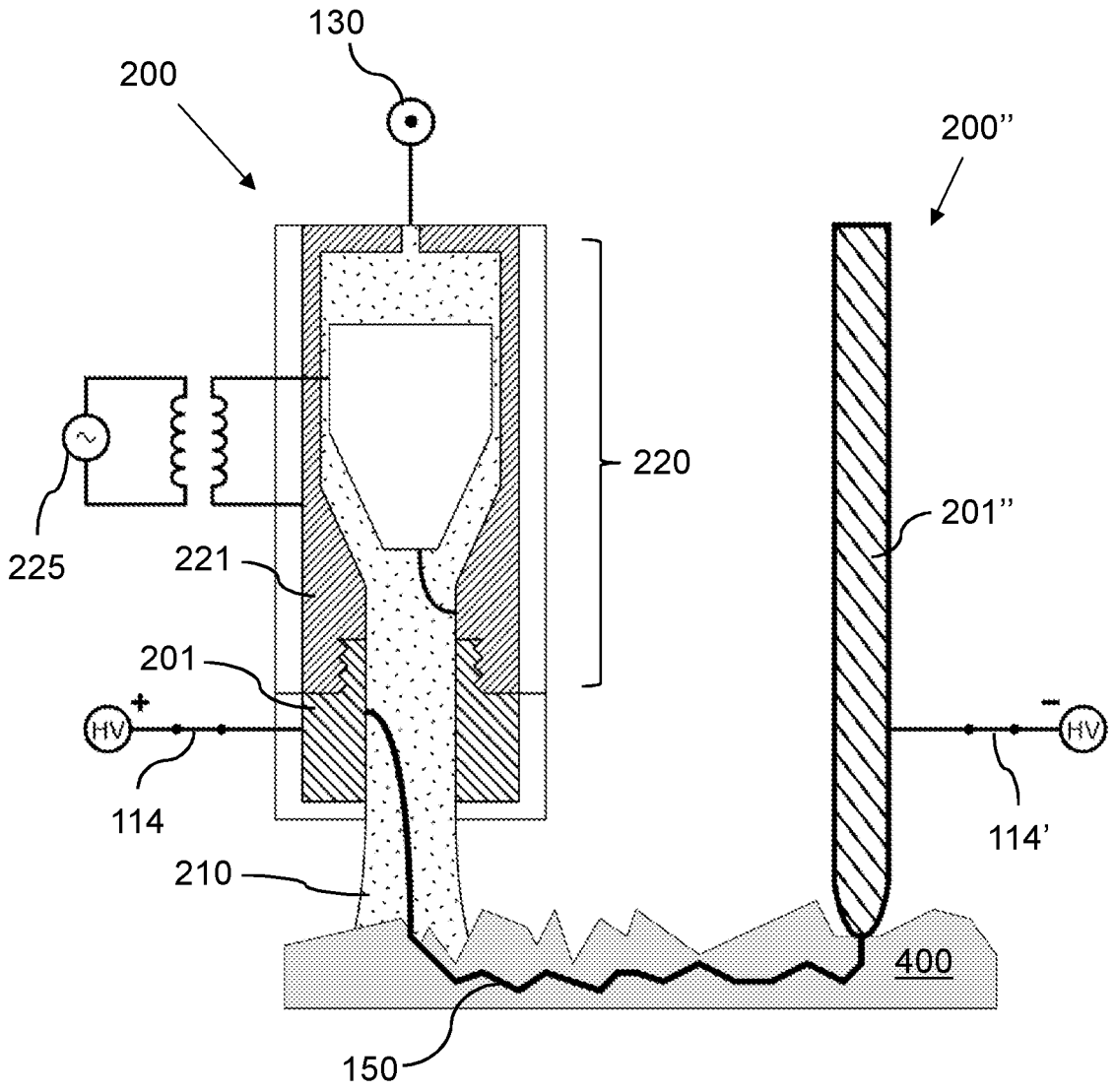
FIG. 2*b* is a sectional view of an electrode pair for a drilling tool according to an embodiment of the disclosure.

FIG. 2*b* shows an alternative electrode setup, in which the pair of electrodes of the drilling tool 100 comprises a plasma generating first electrode 200 as described with reference to FIG. 2*a*, and a solid second electrode 200", comprising a solid electrode portion 201" configured to be mechanically applied against the mineral substrate 400. The first ionized fluid volume 210 is isolated from the second solid electrode portion 201" so that the high voltage current pulse 150 passes between the first solid electrode portion 201 and the second solid electrode 200" via the first ionized fluid volume 210 and the mineral substrate 400.

The drilling tool 100 of the type shown in FIG. 1 may comprise a plurality of electrode pairs, wherein some of the pairs may comprise two plasma generating electrodes 200 and in which some of the pairs may comprise one solid electrode 200".

Figure 3:
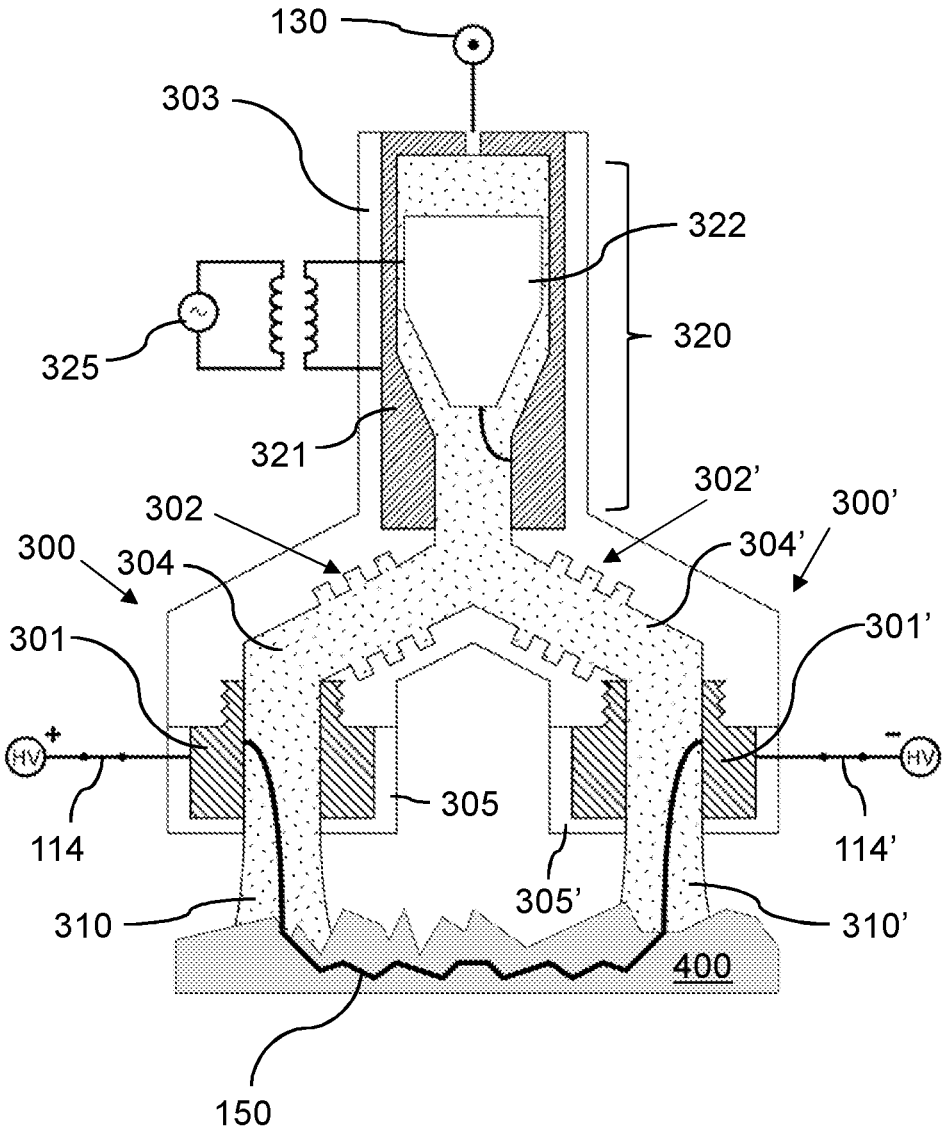
FIG. 3 is a sectional view of an electrode pair for a drilling tool according to another embodiment of the disclosure.

FIG. 3 shows yet an alternative electrode setup, in which a pair of a first electrode 300 and a second electrode 300' shares a common plasma generator 320 arranged upstream of the electrodes 300, 300'. The common plasma generator 320 may be shared by several electrode pairs, although only one pair is illustrated. It is also possible to use a common plasma generator 320 for generating and supplying plasma to first electrodes of a plurality of electrode pairs, and to combine the common plasma generator with a solid second electrode 200" illustrated in FIG. 2*b*.

The plasma generator 320 is arranged downstream of a compressed gas supply system 130, so that compressed gas is supplied to the plasma generator 320, is ionized to form a plasma, and is fed to each of the two electrodes 300, 300'. The plasma generator 320 is of the same type as described with reference to FIG. 2*a*, i.e., it comprises a low voltage power source 325, a conductive casing 321, and a cone shaped plasmatron electrode 322, spaced apart from the casing 321.

The electrodes 300, 300' each comprises a solid electrode portion 301, 301' of the same type as described with reference to FIG. 2*a*, insulated by an insulating protective skin 305, 305'. However, the solid electrode portions 301, 301' are herein mounted to an insulating housing 303 enclosing the plasma generator 320 as well as plasma conduits 304, 304' leading from the plasma generator to first and second solid electrode portions 301, 301', respectively. The insulating housing 303 thus separates the conductive casing 321 from the solid electrode portions 301, 301'. The insulating housing 303 also comprises shielding members 302, 302' configured for preventing the high voltage current pulses generated by the pulsed power generator 110 from passing backward through the generated plasma to the plasma generator 320 and/or between the solid electrode portions 301, 301' without passing through the mineral substrate 400. The shielding members 302, 302' are herein formed by a series of corrugations provided in an inner wall of the insulating housing 303. The plasma generator 320 generates plasma that forms a first ionized fluid volume 310 extending between the first solid electrode portion 301 and the mineral substrate 400, and a second ionized fluid volume 310' extending between the second solid electrode portion 301' and the mineral substrate 400.

The solid electrode portions 301, 301' of the first and second electrodes 200, 200' are galvanically connectable to the pulsed power generator 110 by means of switches 114, 114'. Thus, as the switches 114, 114' are closed, the high voltage current pulse 150 passes between the first solid electrode portion 301 of the first electrode 300 and the second solid electrode portion 301' of the second electrode 300' via the first ionized fluid volume 310, the mineral substrate 400, and the second ionized fluid volume 310'. As a result, a plasma channel is formed in the mineral substrate 400 and the mineral substrate 400 is broken.

As described above with reference to FIG. 1, shielding fluid may be supplied to the region between the electrodes 300, 300'.

The same drilling tool 100 may use a combination of electrodes described with reference to FIG. 2*a*, FIG. 2*b* and FIG. 3. The drilling tool may comprise a plurality of electrode pairs arranged around a perimeter of the drill head 120. The outlet 142 of the shielding fluid conduit 141 may by way of example be positioned at a center of the drill head 120, but a variety of different configurations are possible.

In the illustrated embodiments, the solid electrode portions 201, 301, 301' are protected from the shielding fluid by on one hand the insulating protective skin 202, 305, 305', and on the other hand by the ionized fluid volume 210, 310, 310'. The lack of contact between the solid electrode portions 201, 301, 301' and the flushing fluid leads to smaller volume losses and increased efficiency.

Although the solid electrode portions described with reference to FIG. 2*a*, FIG. 2*b* and FIG. 3 are hollow, they may also be non-hollow similarly to the solid second electrode 200" illustrated in FIG. 2*b*. In that case, the solid electrode portions are immersed in the ionized fluid. A hollow insulating housing, such as tube shaped housing, is in that case also provided, forming an outer housing of the electrode. The solid electrode portion immersed in the ionized fluid, such as in the plasma, transfers the current pulse to the plasma. Since the solid electrode portion is not intended to be in mechanical contact with the mineral substrate 400 and transfer the current via a contact interface, the solid electrode portion, including a tip, can be designed and optimized for current transfer between the tip and the ionized fluid without taking the mechanical strength of the tip into account.

Turning back to FIG. 1, the drill head 120 may further comprise one or more contact members (not shown) protruding in the axial direction of the drilling tool 100 with respect to at least the first solid electrode portion 201, 301, i.e., from the front end 121 of the drill head 120. In addition, or alternatively, the drilling tool 100 may comprise a positioning device (not shown) for controlling a distance between at least the first solid electrode portion 201 and the surface of the mineral substrate 400.

The drilling tool may further comprise an electronic control unit 160 for controlling operation of the drilling tool 100 in response to signals received from an external control unit 170, such as a control unit of a machine in which the drilling tool is provided or. The electronic control unit 160 may include a microprocessor, a microcontroller, a programmable digital signal processor or another programmable device. Thus, the control unit 160 comprises electronic circuits and connections (not shown) as well as processing circuitry (not shown) for communicating with different parts of the drilling tool 100 as well as with the external control unit 170. For example, the control unit 160 may be configured for communicating with various sensors, devices, systems and control units of the drilling tool 100. In the shown embodiment, the control unit 160 controls the transformer 111 as well as the switches 114, 114'. Although not shown, the control unit 160 may also be used for controlling the at least one ionization device, the fluid supply system 140, and/or the compressed gas supply system 130. Alternatively, several separate control units may be provided.

The electronic control unit 160 may comprise modules in either hardware or software, or partially in hardware or software, and communicate using known transmission buses such a CAN-bus and/or wireless communication capabilities. The processing circuitry may be a general-purpose processor or a specific processor. The control unit 160 may comprise a non-transitory memory for storing computer program code and data. Thus, the skilled person realizes that the electronic control unit 160 may be embodied by many different constructions.

Figure 4:
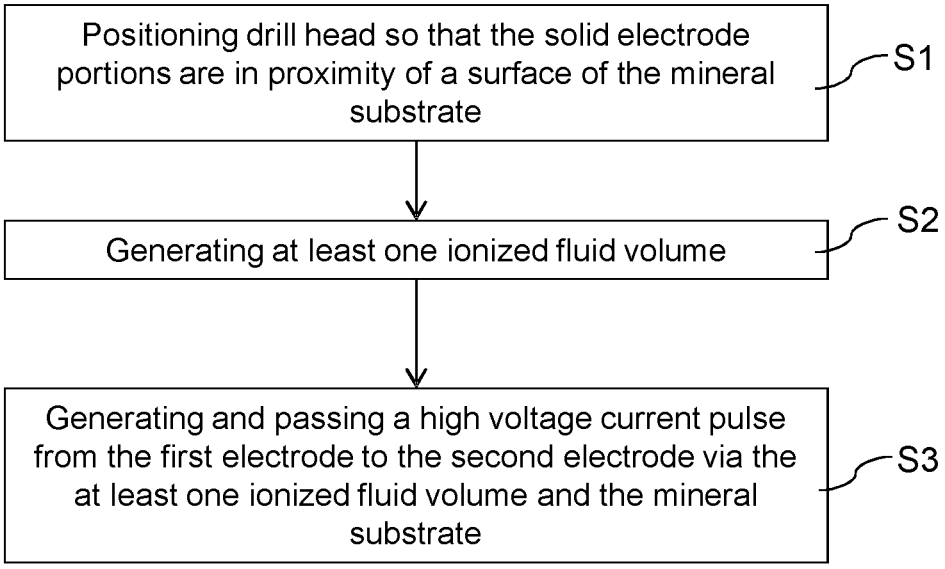
FIG. 4 is a flow-chart illustrating steps of a method according to the disclosure.

A method for breaking a mineral substrate 400 by passing a pulsed electrical current through the mineral substrate 400 by means of the pulsed power drilling tool 100 described above is illustrated in FIG. 4. The method comprises the following actions:

S1: Positioning the drill head 120 so that the solid electrode portions are at least in proximity of a surface of the mineral substrate 400. In the case when the drilling tool 100 comprises a combination of solid electrodes 200" and plasma generating electrodes 200, 300, 300', the solid electrode may be arranged in contact with the surface of the mineral substrate 400 while the remaining electrodes are positioned in the proximity of the surface.

S2: Generating the at least one ionized fluid volume 210, 210', 310, 310', such as by generating the plasma using the one or more plasma generators 220, 320.

S3: Generating and passing a high voltage current pulse 150 from the first electrode 200, 300 to the second electrode 200', 200" via the at least one ionized fluid volume 210, 210', 310, 310' and the mineral substrate 400.

The method may also comprise an optional step of supplying shielding fluid to a region between the electrodes 200, 200', 200", 300, 300' at least during the action of passing the high voltage current pulse from the first electrode 200, 300 to the second electrode 200', 200", 300'. Shielding fluid is preferably continuously supplied.

Figure 5:
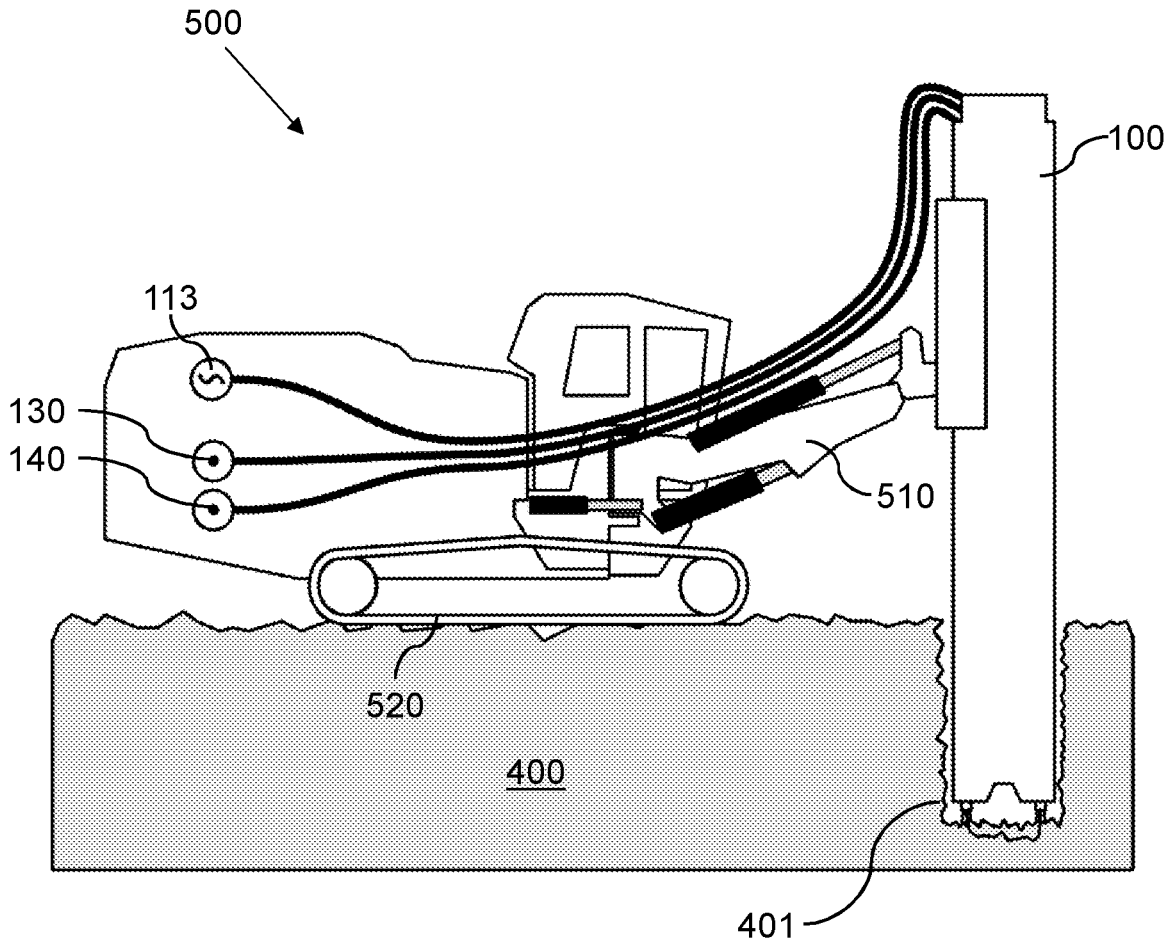
FIG. 5 is a rock drilling machine comprising the drilling tool shown in FIG. 1.

FIG. 5 illustrates schematically a rock drilling machine 500 comprising a drilling tool 100 as shown in FIG. 1 drilling a hole 401 in a mineral substrate 400 in the form of a rock. The rock drilling machine 500 comprises the alternating current (AC) power supply 113 for powering the pulsed power generator 110 and the plasma generator 220, 320. It further comprises the compressed gas supply system 130 and the fluid supply system 140. A hydraulic, pneumatic, or electrically actuated arm 510 for at least vertical positioning of the drilling tool 100 is provided, such as in response to signals from one or more position sensors (not shown) or similar sensing the distance between the electrodes and the mineral substrate surface. The rock drilling machine 500 further comprises ground engaging members 520 for moving the rock drilling machine 500 in a direction parallel with the rock 400.

It is to be understood that the present disclosure is not limited to the embodiments described above and illustrated in the drawings; rather, the skilled person will recognize that many changes and modifications may be made within the scope of the appended claims.

The invention claimed is:

1. A pulsed power drilling tool configured for passing a pulsed electrical current through a mineral substrate to break the mineral substrate, the drilling tool comprising:

a pulsed power generator for generating high voltage current pulses, a drill head comprising at least one pair of a first electrode and a second electrode, the first electrode comprising a first solid electrode portion and the second electrode comprising a second solid electrode portion, the first and second solid electrode portions being galvanically connectable to the pulsed power generator, and at least one ionization device configured for generating at least one ionized fluid volume extending at least from the first solid electrode portion to a surface of the mineral substrate, so as to allow a high voltage current pulse to pass between the first solid electrode portion and the second solid electrode portion via the at least one ionized fluid volume and the mineral substrate.

2. The pulsed power drilling tool according to claim 1, wherein the at least one ionization device is configured for generating a first ionized fluid volume extending at least from the first solid electrode portion to the surface of the mineral substrate, and a second ionized fluid volume extending at least from the second solid electrode portion to the surface of the mineral substrate, the first ionized fluid volume being isolated from the second ionized fluid volume so as to allow the high voltage current pulse to pass via the first ionized fluid volume, the mineral substrate, and the second ionized fluid volume.

3. The pulse power drilling tool according to claim 1, wherein the second solid electrode portion is configured to be mechanically applied against the mineral substrate, and wherein the at least one ionized fluid volume is isolated from the second solid electrode portion.

4. The pulsed power drilling tool according to claim 1, wherein the at least one ionization device comprises at least one plasma generator, and wherein the drilling tool further comprises:

a compressed gas supply system for supplying compressed gas to the at least one plasma generator, wherein the at least one plasma generator is configured to ionize the compressed gas to generate a plasma, the at least one ionized fluid volume being formed by the plasma.

5. The pulsed power drilling tool according to claim 4, wherein the at least one plasma generator comprises a low voltage power source arranged separately from the pulsed power generator.

6. The pulsed power drilling tool according to claim 4, wherein a first plasma generator of the at least one plasma generator is comprised in at least the first electrode and optionally wherein a second plasma generator of the at least one plasma generator is comprised in the second electrode.

7. The pulsed power drilling tool according to claim 6, wherein each plasma generator comprises a casing, the casing being galvanically connectable to the pulsed power generator and further being galvanically connected to the solid electrode portion of the respective electrode in which the plasma generator is arranged.

8. The pulsed power drilling tool according to claim 4, wherein the at least one plasma generator is arranged upstream of the electrodes, the at least one plasma generator being configured to supply plasma to at least the first electrode and optionally to the second electrode.

9. The pulsed power drilling tool according to claim 8, further comprising at least one shielding member configured for preventing the high voltage current pulses generated by the pulsed power generator from passing through the generated plasma to the at least one plasma generator.

10. The pulsed power drilling tool according to claim 1, further comprising a fluid supply system for supplying a shielding fluid to a region between the drill head and the mineral substrate.

11. The pulsed power drilling tool according to claim 1, wherein the drill head comprises at least one contact member protruding in an axial direction of the drilling tool with respect to at least the first solid electrode portion, and wherein the drilling tool comprises a positioning device for controlling a distance between at least the first solid electrode portion and the surface of the mineral substrate.

12. A method for breaking a mineral substrate by passing a pulsed electrical current through the mineral substrate by means of a pulsed power drilling tool, the method comprising:

positioning a drill head that comprises at least one pair of a first electrode and a second electrode, the first electrode comprising a first solid electrode portion and the second electrode comprising a second solid electrode portion so that the first solid electrode portion and the second electrode portion are at least in proximity of a surface of the mineral substrate, generating at least one ionized fluid volume, generating and passing a high voltage current pulse from the first electrode to the second electrode via the at least one ionized fluid volume and the mineral substrate.

13. The method according to claim 12, wherein generating the at least one ionized fluid volume comprises ionizing compressed gas to generate a plasma, the at least one ionized fluid volume being formed by the plasma.

14. The method according to claim 12, further comprising:

supplying a shielding fluid to a region between the first electrode and the second electrode at least during the action of passing the high voltage current pulse from the first electrode to the second electrode.

* * * * *